United States Patent [19]

Billenstein et al.

[11] 4,439,331

[45] Mar. 27, 1984

[54] TEXTILE SOFTENER

[75] Inventors: Siegfried Billenstein, Burgkirchen; Adolf May, Hofheim am Taunus; Hans-Walter Bücking, Kelkheim, all of Fed. Rep. of Germany

[73] Assignee: Hoechst Aktiengesellschaft, Fed. Rep. of Germany

[21] Appl. No.: 412,141

[22] Filed: Aug. 27, 1982

[30] Foreign Application Priority Data

Sep. 4, 1981 [DE] Fed. Rep. of Germany ..... 3135014

[51] Int. Cl.[3] ..... D06M 13/46

[52] U.S. Cl. ..... 252/8.8; 252/8.6

[58] Field of Search ..... 252/8.8

[56] References Cited

U.S. PATENT DOCUMENTS

| | | | |
|---|---|---|---|
| 3,170,938 | 2/1965 | Levis | 252/8.75 |
| 3,920,565 | 11/1975 | Morton | 252/8.9 |
| 4,281,196 | 7/1981 | Rutzen et al. | 252/8.9 |
| 4,351,737 | 9/1982 | Billenstein et al. | 252/8.8 |
| 4,368,127 | 1/1983 | Richmond | 252/8.8 |

FOREIGN PATENT DOCUMENTS

| | | | |
|---|---|---|---|
| 2459354 | 6/1976 | Fed. Rep. of Germany | 252/8.8 |
| 808265 | 1/1959 | United Kingdom | 252/8.8 |

*Primary Examiner*—Maria Parrish Tungol

*Attorney, Agent, or Firm*—Connolly and Hutz

[57] ABSTRACT

Liquid textile softeners composed of an aqueous solution or dispersion of compounds of the formula I

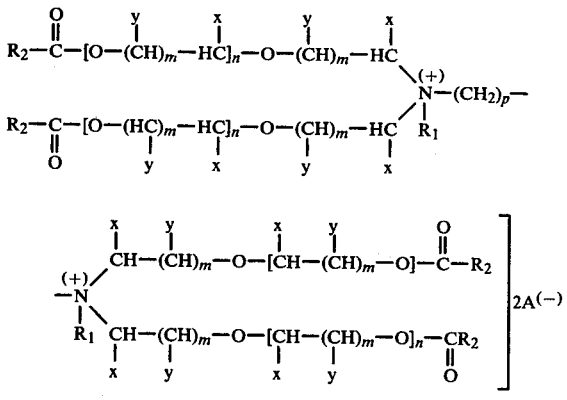

wherein $R_1$ denotes $C_1$–$C_4$ alkyl, x and y each denote hydrogen or methyl, it being excluded, however, for x and y to denote simultaneously methyl, n is an integer of from 1 to 10, m is the integer 1 or 2, p is an integer of from 1 to 5, $R_2$ denotes $C_8$–$C_{30}$ alkyl and, if appropriate, other auxiliaries.

8 Claims, No Drawings

TEXTILE SOFTENER

It is known that certain cationic quaternary ammonium compounds, when added to the last rinse in the washing machine, impart a good handle and, at the same time, antistatic properties to various types of fabric, such as, for example, cotton, wool and mixed cotton-synthetic fabrics. However, there are certain difficulties involved in manufacturing the more highly concentrated formulations of these textile softeners and distributing them uniformly in the cold rinsing water, since on adding softeners in the form of concentrated aqueous or alcoholic solutions, gel-like sedimentation occurs which can lead to the formation of spots on the laundry. Even the dilution of this type of concentrate to give a commercial 2–5% strength formulation involves difficulties. Usually, a gel-like mixture is obtained which is dispersible in cold water with difficulty or not at all.

Textile softeners have thus generally been used hitherto in the form of dilute, about 2–10% strength aqueous solutions. However, these dilute solutions have various disadvantages. For example, they cannot be stored in the cold since, after freezing and thawing again, they assume the consistency of a gel and can no longer be converted into a homogenous solution. A further disadvantage is the high water content of these solutions, which is inherently superfluous.

It has now been found that it is possible to manufacture concentrated liquid formulations of textile softeners which do not have these disadvantages of the dilute solutions, and which also distribute in cold rinsing water.

Thus the invention relates to liquid textile softeners composed of an aqueous solution or dispersion of compounds of the formula I

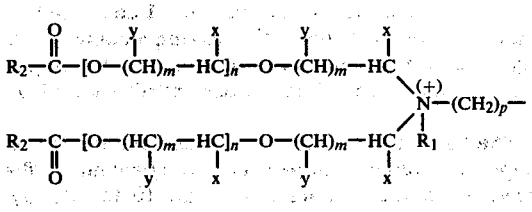

-continued

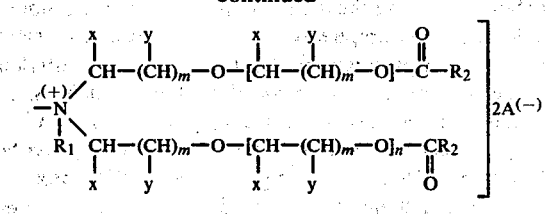

wherein $R_1$ denotes $C_1$–$C_4$ alkyl, x and y each denote hydrogen or methyl, it being excluded, however, for x and y to denote simultaneously methyl, n is an integer of from 1 to 10, m is the integer 1 or 2, p is an integer of from 1 to 5; $R_2$ denotes $C_8$–$C_{30}$ alkyl and A denotes an anion, and, if appropriate, other auxiliaries. Preferred anions for A are chloride, methosulfate, ethosulfate, methophosphate or ethophosphate ions. Methyl is the preferred radical for $R_1$.

These compounds, which are known from U.S. patent application No. 3,170,938, are manufactured by reacting a diamine of the formula $$H_2N-(CH_2)_p-NH_2$$

with ethylene oxide or propylene oxide or a mixture thereof, according to known procedures.

This reaction gives compounds of the formula

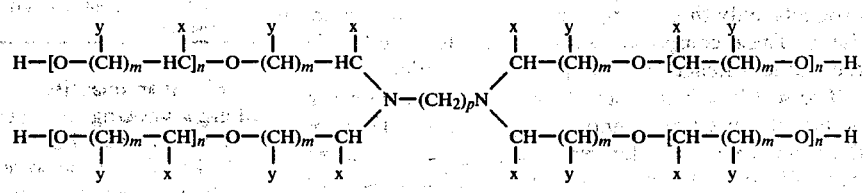

The resultant compounds are reacted with long-chain fatty acids according to known procedures to give N,N,N′,N′-poly(2-hydroxyalkyl)-1,2-diaminoethane-mono-, -di-, -tri- or -tetrafatty acid alkyl esters of the formula

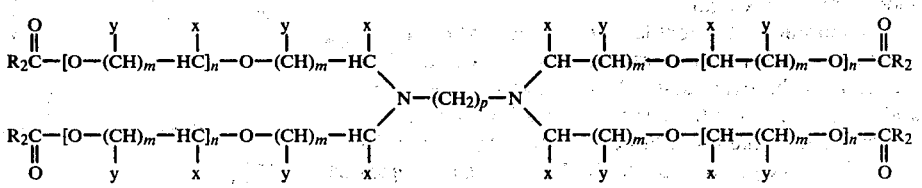

The quaternary compounds to be used according to the present invention are reacted according to known processes by treating compounds of the latter formula with alkylation reagents such as alkylhalides or alkyl sulfuric acid esters. Depending on the type of fatty acid used, the quaternary compounds are obtained in most various forms reaching from a highly viscous liquid to a solid substance. In the formulation of the textile softeners according to the invention, these cationic softening compounds are advantageously employed in the form of their concentrated solutions in lower alcohols, preferably isopropanol, or in a mixture of these alcohols with water. The textile softeners according to the invention in this case contain a defined amount of lower alcohols of this type (about 5–30% by weight).

The textile softeners according to the invention can also contain customary non-ionic dispersants or emulsifiers which are based on oxyalkylates and which contribute to making the textile softener easily dispersible in cold water. Examples of suitable no-ionic dispersants are reaction products of about 2–12 moles of ethylene oxide in each case with an alkylphenol, such as, for example, xylenol, or with an alkylphenol having a long alkyl radical with 8–10 C atoms, or with a fatty alcohol having 8 to 15 C atoms, in particular reaction products of about 5 to 8 moles of EO with 1 mole of alkylphenol or 1 mole of a fatty alcohol containing 8 to 15 C atoms or a mixture of fatty alcohols of this type. The amount of these non-ionic compounds is 3 to 10% by weight in low-concentration textile softeners, which have a content of about 10 to 30% by weight of the compounds of the formula I. More concentrated textile softeners, having a content of about 30 to 70% by weight of the compounds of the formula I, preferably contain 5 to 20% by weight of the non-ionic dispersant. The addition of dispersing agents of this type is unnecessary for the dilute commercial textile softeners. Dilute textile softeners of this type contain the quaternary ammonium compound in a concentration of from 2 to 10%.

Preferably, more concentrated textile softeners of this type additionally contain 5 to 30% by weight of an ethylene glycol, propylene glycol, polyethylene glycol, or polypropylene glycol or the $C_1$–$C_4$-alkyl ethers of these compounds. It is obvious that, of this group of products, only those compounds are suitable which are liquid. These compounds show a solubilizing effect in the textile softeners according to the invention.

The textile softeners according to the invention can be manufactured by simply mixing the components or their concentrated solutions. If appropriate, perfume, dyestuff, optical brighteners or other auxiliaries can also be added. To obtain the desired final concentration, the product is diluted, if appropriate, with the amount of water necessary for this purpose. The amounts of the individual components are selected within the limits indicated so that the finished agent, including any additional amounts of water, perfume and dyestuffs, provides 100% by weight.

The amount of the textile softeners according to the invention employed is, relative to a wash which fills a washing machine (about 4 kg), 80 to 150 ml, 30 to 70 ml and 10 to 20 ml for a textile softener having a content of a compound of the formula I of 2 to 10% by weight, 10 to 30% by weight and 30 to 70% by weight respectively.

The textile softener according to the invention, which exhibit good softening properties, can be easily dispersed in cold water without troublesome formation of a gel occuring. In this context, it is advantageous that these concentrates can be introduced, with suitable metering devices, directly into domestic machines. This good solubility also permits dilution of the concentrate according to the invention only shortly before its introduction into the washing machine, so that the textile softener can also be marketed in a concentrated form and not only as dilute aqueous solutions. Due to this, it is no longer necessary to transport, at all stages of marketing, large amounts of water, which are superfluous in the final analysis.

The examples below serve to illustrate the invention. Quantities are by weight, unless otherwise stated.

EXAMPLE 1

| | |
|---|---|
| Textile softener of the formula I<br>$R_2$ = oleic acid, p = 2, x, y = H, m = 1<br>n = O, $R_1$ = $CH_3$, A = $CH_3OSO^-$;<br>water, perfume, dyestuff | 5%,<br>the remainder<br>to 100%. |

Application quantity: 100 ml per wash filling a washing machine (4 kg of dry wash).

EXAMPLE 2

| | |
|---|---|
| Concentrated textile softener, compound according to the invention of the formula I<br>$R_2$ = tallow fatty acid, p = 2, x, y = H,<br>m = 1, n = O, $R_1$ = $CH_3$, A = $CH_3OSO_3^-$;<br>water, perfume, dyestuff | 20%,<br>the remainder<br>to 100%. |

Application quantity: 20 ml of formulation per wash filling a washing machine.

EXAMPLE 3

| | |
|---|---|
| Highly concentrated textile softener, compound according to the invention of the formula I | 67%, |
| $R_2$ = oleic acid, p = 2, x, y = H; m = 1,<br>n = O, $R_1$ = $CH_3$, A = $CH_3OSO_3^-$ | 10%, |
| nonylphenol + 6 EO (emulsifier) | |
| diethylene glycol (solvent) | 20%, |
| perfume | 3%. |

Application quantity: 5 ml of formulation per wash filling a washing machine.

What is claimed is:

1. Liquid textile softener composed of an aqueous solution or dispersion of compounds of the formula

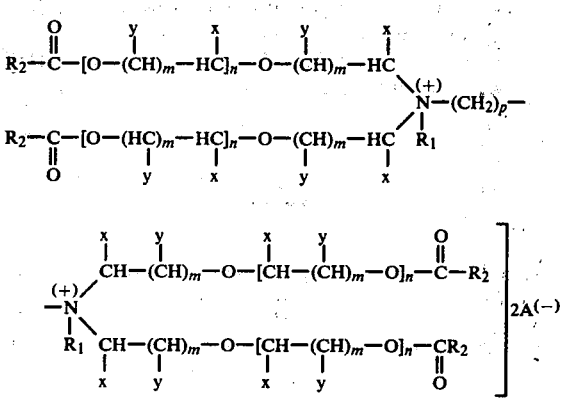

wherein $R_1$ denotes $C_1$–$C_4$ alkyl, x and y each denote hydrogen or methyl, it being excluded, however, for x and y to denote simultaneously methyl, n is an integer of from 1 to 10, m is the integer 1 or 2, p is an integer of from 1 to 5, $R_2$ denotes $C_8$–$C_{30}$ alkyl and A denotes an anion, and, if appropriate, other auxiliaries.

2. The liquid textile softener of claim 1 composed of an aqueous solution of dispersion having a content of a compound of the formula I of from 2 to 10% by weight and a content of a non-ionic dispersant of from 0.1 to 3% by weight.

3. The liquid textile softener of claim 1 composed of an aqueous solution or dispersion having a content of a compound of the formula I of from 10 to 30% by weight and a content of a non-ionic dispersant of from 3 to 10% by weight.

4. The liquid textile softener of claim 1 composed of an aqueous solution or dispersion having a content of a compound of the formula I of from 30 to 70% by weight, a content of a non-ionic dispersant of from 5 to 20% by weight, a content of a $C_1$–$C_5$ alkanol of from 5 to 30% by weight and a content of a liquid glycol, polyglycol or an alkylic ether thereof of from 5 to 30% by weight.

5. Liquid textile softener composition comprising a solution or dispersion of a compound of the formula

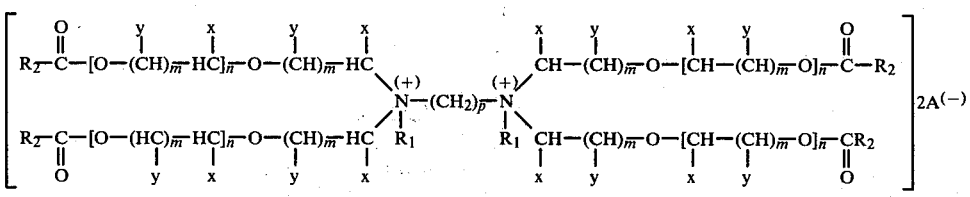

(I)

wherein $R_1$ denotes $C_1$–$C_4$ alkyl, x and y each denote hydrogen or methyl, it being excluded, however, for x and y to denote simultaneously methyl, n is an integer of from 1 to 10, m is the interger 1 or 2, p is an integer of from 1 to 5, $R_2$ denotes $C_8$–$C_{30}$ alkyl and A denotes an anion, the solvent or dispersing medium for said softener composition being water or a liquid glycol, polyglycol or alkyl ether thereof.

6. The liquid textile softener of claim 5 comprising an aqueous solution or dispersion having a content of a compound of the formula I of from 2 to 10% by weight and a content of a non-ionic dispersant of from 0.1 to 3% by weight.

7. The liquid textile softener of claim 5 comprising an aqueous solution or dispersion having a content of a compound of the formula I of from 10 to 30% by weight and a content of a non-ionic dispersant of from 3 to 10% by weight.

8. The liquid textile softener of claim 5 comprising a solution or dispersion having a content of a compound of the formula I of from 30 to 70% by weight, a content of a non-ionic dispersant of from 5 to 20% by weight, a content of a $C_1$–$C_5$ alkanol of from 5 to 30% by weight and a content of a liquid glycol, polyglycol or an alkylic ether thereof from 5 to 30% by weight.

* * * * *